United States Patent [19]

Beneke et al.

[11] 4,232,426

[45] Nov. 11, 1980

[54] WEB GUIDING DEVICE

[75] Inventors: Wolfgang Beneke; Paul G. Teichmann; Wilfried Weber, all of Mönchen-Gladbach, Fed. Rep. of Germany

[73] Assignee: Trützschler GmbH & Co. KG, Mönchen-Gladbach, Fed. Rep. of Germany

[21] Appl. No.: 887,215

[22] Filed: Mar. 16, 1978

[30] Foreign Application Priority Data

Mar. 17, 1977 [DE] Fed. Rep. of Germany ..... 2711619

[51] Int. Cl.[2] ..... D01G 15/46

[52] U.S. Cl. ..... 19/106 R; 19/150; 19/157

[58] Field of Search ..... 19/150, 157, 106 R; 226/196

[56] References Cited

U.S. PATENT DOCUMENTS

| | | | |
|---|---|---|---|
| 1,648,050 | 11/1927 | Kevlin et al. | 19/150 |
| 2,903,751 | 9/1959 | Allred | 19/150 X |
| 3,196,492 | 7/1965 | Binder et al. | 19/106 |
| 3,362,049 | 1/1968 | Kiser | 19/150 X |
| 3,533,138 | 10/1970 | Whitehurst | 19/157 X |
| 3,840,942 | 10/1974 | Thomason, Jr. | 19/150 |
| 3,946,464 | 3/1976 | Meinke et al. | 19/150 |

FOREIGN PATENT DOCUMENTS

| | | | |
|---|---|---|---|
| 96352 | 11/1923 | Austria . | |
| 2623400 | 3/1977 | Fed. Rep. of Germany | 19/157 |
| 934611 | 8/1963 | United Kingdom . | |
| 1177461 | 1/1970 | United Kingdom | 19/150 |
| 1358990 | 7/1974 | United Kingdom | 19/150 |

*Primary Examiner*—Louis Rimrodt
*Attorney, Agent, or Firm*—Spencer & Kaye

[57] ABSTRACT

A device for gathering a running fiber web delivered by a pair of cooperating rolls (forming part of a web delivering assembly arranged downstream of a carding machine) includes at least one operationally substantially stationary guide element having a hollow guiding face. The guide element is supported downstream of and immediately adjacent to the rolls of the web delivering assembly. The hollow guiding face extends transversely to the direction of advance of the web as the latter leaves the rolls and shrouds at least one part of both rolls.

21 Claims, 32 Drawing Figures

WEB GUIDING DEVICE

BACKGROUND OF THE INVENTION

This invention relates to a device for withdrawing a fiber web from a web delivering assembly of a carding machine and for gathering the web into a sliver with the aid of a guide element which is arranged immediately downstream of the web delivering assembly and which has a guiding face which traverses the plane of the web.

In a known web guiding device, as disclosed in U.S. Pat. No. 3,946,464, the guide element is formed of at least two transport belts. Those reaches of the one and the other transport belt which are arranged tangentially to the web delivering assembly, run in opposite directions. In this device the guide element has at least one moving guiding face. This arrangement requires that the transport belts run on driven rollers; such a structure is prone to malfunctioning. Further, the transport belts have to be maintained under constant tension which requires additional work and maintenance. Also, the entire apparatus is of complex and expensive structure. It is a further disadvantage that the guiding faces of the transport belts are planar so that air may impinge from above downwardly without hindrance on the web emerging from the web delivering assembly. This disadvantage is particularly pronounced in case the web leaves the delivering assembly at high speeds.

In another known web guiding device, disclosed in U.S. Pat. No. 3,196,492, the card web is discharged by the doffer of a carding machine and is supported by guiding faces. This guiding device adjoins the doffer and extends to the calender roll pair. For this purpose, between these components there is arranged an asymmetrically structured planar triangular sheet metal web guide member which has two lateral web guiding means constituted by upwardly bent edges. The longitudinal edge rims which have a somewhat downwardly oriented inclination, thus form an acute angle with the axis of the doffer so that the entire device forms a funnel-like structure. The web guiding device is open between the two edges, so that the web which slides over the sheet metal guide is exposed to air from above. As a result, the web may, particularly in case of high speeds, break out upwardly. It is known that the fiber web which is discharged by the carding machine at high speeds has to be gathered with an equally high speed. As the web slides over the sheet metal guide, it may suffer accumulation or breakage caused by local differences in adhesion. These phenomena adversely affect the flow of production as well as the quality of the fiber web obtained. A withdrawal and a gathering of a web running at high speeds is therefore not feasible with this known device.

In a further web guiding device disclosed in U.S. Pat. No. 3,840,942 a pair of guide elements detached from one another are arranged at either side of the web discharged by the crush rolls of a carding machine. There are provided adjusting devices which move the guide elements from an outer position in which no web condensing effect exists into an inner position in which the web is gathered to an approximately T-shaped sliver. Both guide elements are significantly shorter than the length of the crush rolls and for this reason they have to be arranged at a certain distance from the crush rolls in order to be capable of gathering the entire web emerging from the crush rolls. Since the web is exposed to a strong air current in this device, the latter is not adapted for high web speeds, since the web would break under the effect of the air.

SUMMARY OF THE INVENTION

It is an object of the invention to provide an improved web guiding device from which the above-discussed disadvantages of the prior art arrangements are eliminated and which thus, by means of a particularly simple structure, is capable of withdrawing the web discharged at high speeds by a web delivering assembly and gathering the same into a sliver in a secure manner.

This object and others to become apparent as the specification progresses, are accomplished by the invention, according to which, briefly stated, the device for gathering a running fiber web delivered by a pair of cooperating rolls (forming part of a web delivering assembly arranged downstream of a carding machine) includes at least one operationally substantially stationary guide element having a hollow guiding face. The guide element is supported downstream of and immediately adjacent to the rolls of the web delivering assembly. The hollow guiding face extends transversely to the direction of advance of the web as the latter leaves the rolls and shrouds at least one part of both rolls.

By virtue of the fact that the guide element according to the invention has at least one immobile guiding face in contradistinction to the prior art structure disclosed in U.S. Pat. No. 3,946,464, a web guiding device of economical structure may be manufactured in a particularly simple manner which is maintenance-free and operates in a secure manner. The particular advantage thus resides in the fact that no moving components such as rolls, transport belts or the like are present. The guiding face oriented towards the web delivering assembly is of hollow construction. In this manner, no air may impinge from above to the gathered web. The web guiding device structured according to the invention effects, with unexpectedly simple means, a highly satisfactory withdrawal and a simultaneous gathering of the high-speed fiber web. By the inward rolling of the web edges—probably caused by the air flow within the guiding face—the fiber web is stabilized. It is an additional advantage that the web orientation remains maintained in a large measure.

In contradistinction to the prior art structure disclosed in U.S. Pat. No. 3,169,492, the web according to the invention leaves the web delivering assembly and impinges directly—in an approximately perpendicular orientation—on the guiding faces (contrary to the known arrangement). Thereafter, the web is deflected at a right angle and further advanced within the guiding faces. By virtue of the fact that the rolls of the web delivering assembly are shrouded by the guiding faces, the web is shielded from the effect of external air. Thus, together with the positive guidance, it is ensured that the web is prevented from breaking out upwardly. It is, as known, a matter of identity between the speed of web withdrawal and the speed of web delivery. Probably, the web speed within the guiding faces is enhanced by the air stream emanating from the web delivering assembly. The inward rolling of the web edges is probably also effected by the air flow within the guiding faces; this phenomenon stabilizes the advancing web.

Contrary to the prior art structure disclosed in U.S. Pat. No. 3,840,942, the guide element according to the invention is arranged in an immediately adjoining relationship with the rolls of the web delivering assembly. The hollow guiding face of the guide element extends perpendicularly to the travel of the web upon its discharge by the web delivering assembly and at least one part of both rolls is conformingly shrouded by the hollow guiding face. By virtue of the fact that the guide element is arranged in the immediate vicinity of the rolls that deliver the web, the web is insulated from the effects of the external air. By providing that at least one portion of both rolls is conformingly shrouded by the guiding face, there is ensured a positive guidance of the web. The web, downstream of the crush rolls, is of veil-like structure: it is quite thin and ruptures easily. According to the invention, the web is, immediately downstream of the crush rolls, gathered and folded-in, so that substantially higher operational speeds may be achieved without the danger of rupture. In case of a web, particularly which is formed of short fibers, the advancing speed may be increased from the conventional 60 m/min to 80 m/min and in case of a coarse web, particularly a web consisting of medium and large length fibers, the speed may be increased from the conventional approximately 150 m/min to approximately 210 m/min. The invention makes possible the processing of short fibers (noil) which constitutes residues of large quantities during the combing of cotton. In the known device, the web discharged by the crush rolls has an approximately triangular shape and thus ruptures during the processing of relatively short fibers, because the latter are held together only slightly. In accordance with the invention, the fibers, without the need of holding them together in a substantial measure, are, immediately upon their exit from the crush rolls, gathered and folded-in and are thus withdrawn as a card sliver.

Preferably, the horizontal longitudinal edges of the guiding face extend at least approximately parallel to the web delivering assembly in such a manner that one guiding face shrouds both rolls of the web delivering assembly. In case these longitudinal edges are flush and in an immediately adjoining relationship with the rolls of the web delivering assembly, air streams are prevented from having an adverse effect on the web. The device according to the invention is simple to manufacture, particularly in case the guiding face is arranged parallel to the web delivering assembly.

According to a further feature of the invention, in order to facilitate the starting operation, the guiding face is displaceable (adjustable) relative to the web delivering assembly. Such adjustment may be parallel to the direction of web advance or may be a pivotal motion that the guiding face executes about a vertical or a horizontal axis. In this manner, during operation, the web to be withdrawn and gathered may be observed and defects such as thickened or thinned portions, knots or unfavorable fiber orientations may be detected and thus the operation of the carding machine may be monitored.

The hollow shape of the guiding face may be a concave circular cylindrical or elliptical surface or may have a prismatic cross section dependent upon the properties of the fiber to be processed, the delivery speed and the sliver number, to thus ensure the most favorable configuration regarding flow dynamics.

In accordance with a further feature of the invention, a web division is achieved by withdrawing the web on either side of a one-piece guiding face. Or, in the alternative, in a one-piece guiding face there are provided two openings, such as bore holes, or there are provided three juxtapositioned guiding faces which define two openings, such as gaps for withdrawing therethrough two fiber slivers.

In accordance with a further feature of the invention, in a one-piece guiding face there is provided at least one discharge opening which may be constituted by a bore hole or by an upwardly or downwardly open aperture. The guiding face has, particularly in the zone of the lateral edges, the bore hole or the upwardly or downwardly opened aperture, rounded edges to ensure a smooth guidance of the web.

In case the guiding faces of a two-piece guide element are pivotal about a vertical axis or in case a one-piece guide element is displaceable in the direction of the web advance, during start-up, the web is manually twisted while the guiding faces are open and is passed through a trumpet and then forwarded to the calender rolls. Thereafter, the guiding faces are pivoted or shifted into a closed position in the direction of the rolls of the web delivering assembly, whereupon the withdrawal speed of the sliver can be increased to, for example, over 250 m/min. In this position, the guiding faces are longitudinally aligned with one another and are immediately adjacent and parallel to the rolls of the web delivering assembly. During operation, the guiding faces may be opened (pivoted or shifted) while adjusting the working speed so that the web may be observed. Dependent upon the properties of the material to be processed, the advancing speed and the sliver number, the guiding faces may, however, remain in an open position, that is, they may remain shifted-away from the rolls of the web delivering assembly or may be at an acute angle (partially open position) with respect thereto.

A displaceability of the guiding faces parallel to the rolls of the web delivering assembly has the particular advantage that ample space is available for the manual start-up and for monitoring the operation so that a high degree of convenience can be achieved in attending the machine.

In case the guiding face conformingly shrouds the rolls of the web delivering assembly essentially in their entirety, there is ensured an optimal shielding of the advancing web against adverse effects of the external air.

In accordance with a further feature of the invention, the guiding face of the guide element is arranged at an oblique inclination with respect to the rolls of the web delivering assembly, while the horizontal upper and lower longitudinal edges thereof extend along the rolls in the immediate vicinity thereof. Preferably, the guide element is somewhat shorter than the length of the rolls, that is, the lateral edges of the guide element are arranged inwardly at a distance from the ends of the two rolls. Consequently, the calender assembly (the trumpet and the calender rolls) can be arranged at the edge of the carding machine; this constitutes a structurally simplified solution.

BRIEF DESCRIPTION OF THE DRAWINGS

FIGS. 5*a* through 16*a* and 5*b* through 16*b* are perspective and top plan views, respectively, of different embodiments of the invention.

DESCRIPTION OF THE PREFERRED EMBODIMENTS

Figure 1:
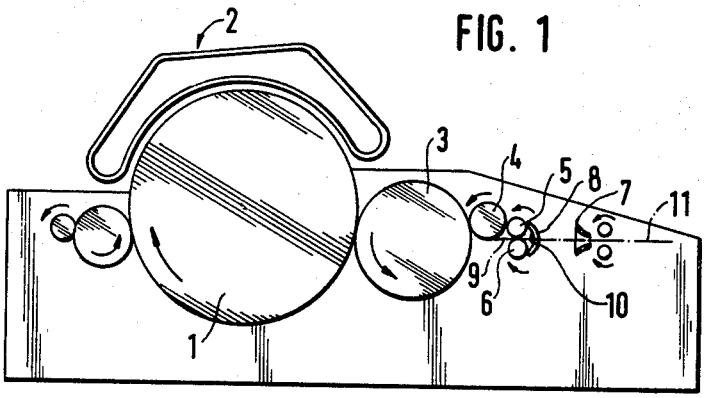
FIG. 1 is a schematic side elevational view of a carding machine incorporating the invention.

Turning now to FIG. 1, with the cylinder 1 of a carding machine 2, there are associated a doffer 3, an evener roller 4, a web delivering assembly formed, for example, of crush rolls 5 and 6 and a trumpet 7. Immediately downstream of the crush rolls 5 and 6 there is arranged a guide element 8. The guiding face 10 of the guide element 8 is of semi-cylindrical hollow construction oriented towards the fiber web 9 emerging from the crush rolls 5 and 6. The guiding face 10 is stationary during operation and is shaped in such a manner that it shields both crush rolls 5 and 6. The longitudinal edges (which are not shown in FIG. 1) of the guiding face 10 are substantially flush with the respective surfaces of the crush rolls 5 and 6: the longitudinal edges are associated with upper and lower peripheral points on the crush rolls 5 and 6. While the guide element 8 is mounted in an operationally stationary manner, it may be adjustable by pivoting it about a vertical axis by means of a pivot element, such as a hinge (not shown in FIG. 1) provided in the zone of one arcuate lateral edge.

In operation, the fiber web 9 discharged by the crush rolls 5 and 6 impinges on the guiding face 10 in such a manner that the web 9 is rolled inwardly in folds. In this manner, the fiber web 9 is gathered and drawn off in the direction predetermined during the start-up of the apparatus. The gathered web 9 is, for the purpose of withdrawing it from the guiding face 10, guided around a rounded lateral edge of the guide element 8 and is combined in the trumpet 7 into a sliver 11.

Figure 2:
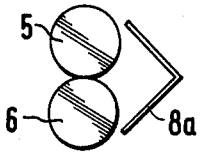
FIGS. 2, 3 and 4 are schematic side elevational views showing different configurations of the web guiding device according to the invention.
Figure 3:
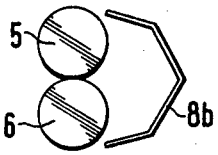
Figure 4:
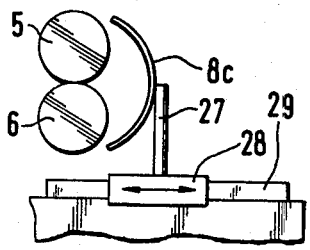

Turning now to FIGS. 2, 3 and 4, there are shown the crush rolls 5 and 6 associated with guide elements 8*a*, 8*b* and 8*c*, respectively, having various configurations. Thus, FIG. 2 shows the guide element 8*a* as being constituted essentially of two planar parts which meet in an edge that is spaced from the crush rolls 5 and 6. This embodiment is thus formed of planar plate members which are interconnected by a seam and are therefore easy to manufacture. The guide element 8*b* shown in FIG. 3 has a prismatic configuration and comprises four planar parts each being arranged at an angle to the adjoining part. By arranging the four planar parts in this manner, a substantial space may be provided between the guide element and the crush rolls. The guide element 8*c* shown in FIG. 4 has a cross-sectionally elliptical configuration. The guide element 8*c* is attached by means of a holder 27 to a support slide 28 which is mounted on a rail 29 and which provides for a horizontal linear displacement of the guide element 8*c* towards and away from the crush rolls 5 and 6. The elliptical configuration provides for a particularly advantageous guidance of the web. All three guide elements 8*a*, 8*b* and 8*c* are open in the direction of the crush rolls 5 and 6 for receiving the fiber web 9.

FIGS. 5*a* through 16*a* and 5*b* through 16*b* to be described in more detail below show various embodiments of the web guiding device. It will be understood that features which are disclosed in these drawings can be combined with one another to provide additional embodiments.

Figure 5C:
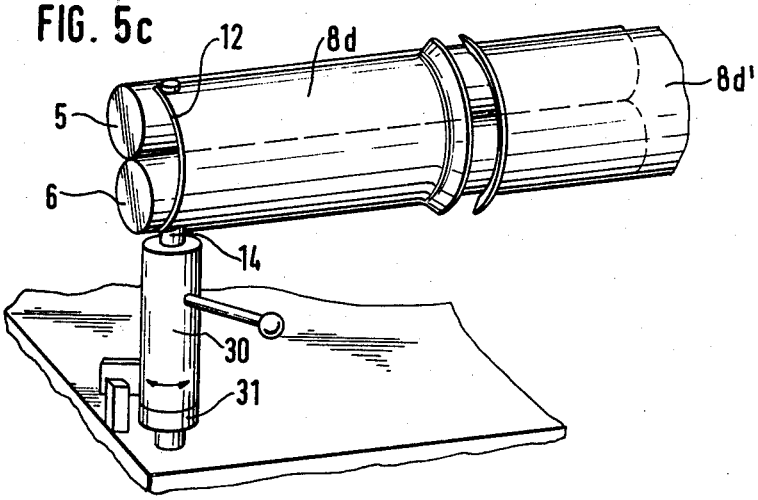
Figure 5A:
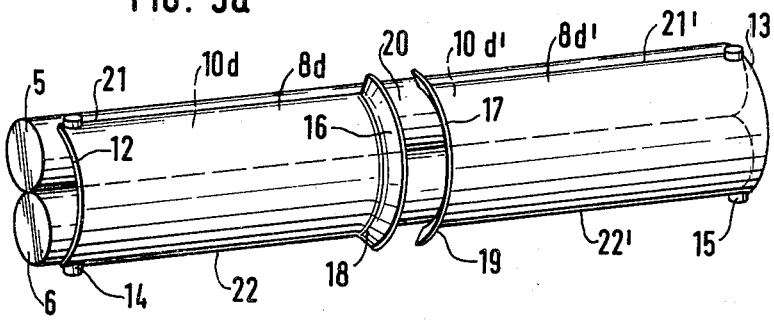
Figure 5B:
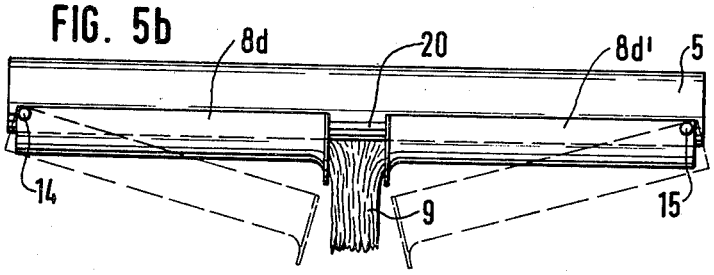

FIG. 5*a* illustrates a two-part guide element which is formed of parts 8*d* and 8*d*'. In the zone of the outer lateral edges 12 and 13 of the parts 8*d* and 8*d*' pivot elements 14 and 15 are provided which permit the respective guide element part to be pivoted about a vertical axis. The inner edges 16 and 17 of the guide element parts 8*d* and 8*d*' have outwardly oriented rounded portions 18 and 19, between which there is provided a throughgoing vertical slot 20. The upper horizontal longitudinal edges 21, 21' and the lower horizontal longitudinal edges 22 and 22' of the parts 8*d* and 8*d*' are flush with the upper and lower periphery of the crush rolls 5 and 6. FIG. 5*b* illustrates how the fiber web 9 is drawn in its gathered condition through the slot 20 between the guiding faces 10*d* and 10*d*'. The guiding faces 10*d* and 10*d*' extend parallel to the crush rolls 5 and 6. Upon rotation about the pivot elements 14 and 15, the parts 8*d* and 8*d*' assume their position shown in broken lines.

FIG. 5*c* shows further details how the guide elements 8*d* and 8*d*' shown in FIGS. 5*a* and 5*b* are supported. The part 8*d* is, in the zone of the lateral edge 12 mounted on the upper end of a pivot post 30 rotatable about a vertical axis. The pivot post 30 has, at its lower end, a bearing 31 which is fixedly mounted on the frame of the carding machine.

The two-part embodiments in accordance with FIGS. 5*a*, 5*b* and 5*c* make possible—by virtue of the provision of the throughgoing slot 20—a pivotal adjustment of the guide element parts 8*d* and 8*d*'.

Figure 6A:
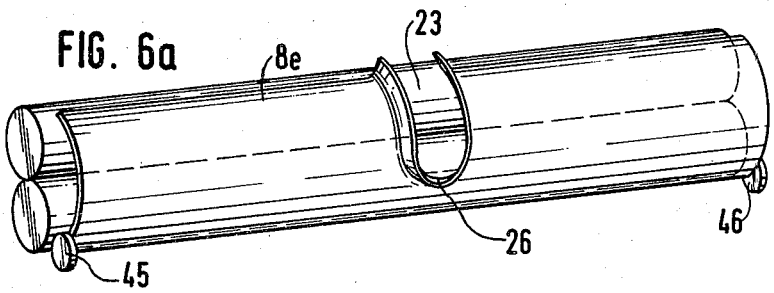
Figure 6B:
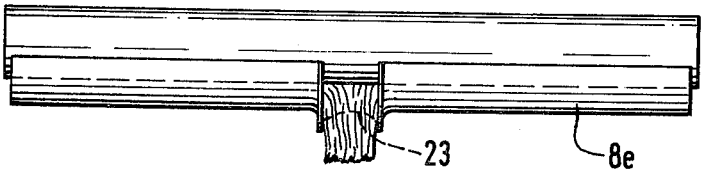

FIGS. 6*a* and 6*b* show a one-piece guide element 8*e*. In the mid zone of the guide element 8*e*, there is provided an only upwardly open slot 23. The latter is U-shaped and has rounded edges 26. The upwardly open slot 23 has the advantage that the card sliver lies therein as in a trough and thus a particularly simple start-up operation may be effected.

Figure 7A:
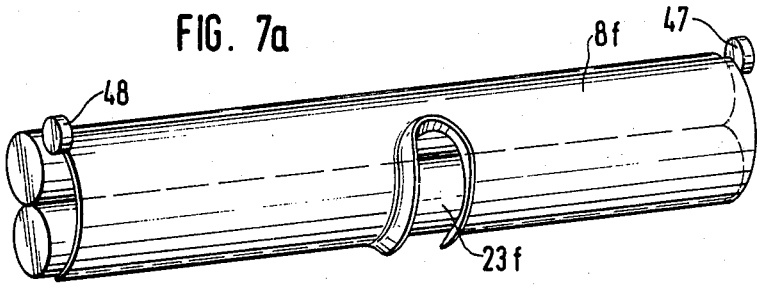
Figure 7B:
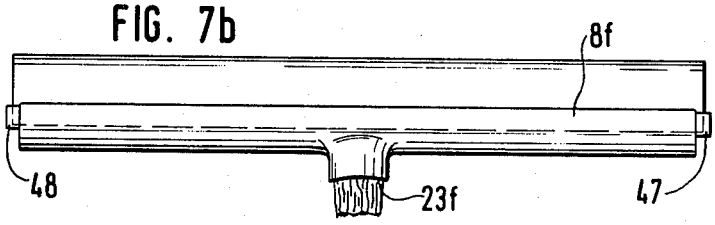

The embodiment illustrated in FIGS. 7*a* and 7*b* is similar to that shown in FIGS. 6*a* and 6*b*, except that the single-piece guide element 8*f* has an only downwardly open slot 23*f*. This arrangement is advantageous in that in case of rupture, the card sliver may drop out of the slot 23*f*. The guide element 8*f* may be mounted by means of pivot members 47 and 48 which are arranged at opposite upper corners of the guide element and which have aligned, horizontal pivotal axes permitting an upward and downward pivotal adjustment of the guide element 8*f*.

Figure 8A:
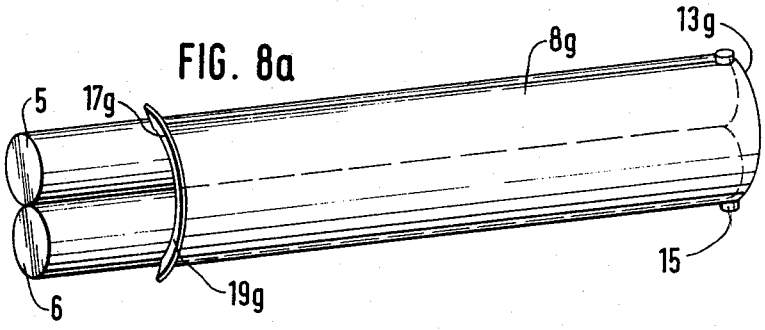
Figure 8B:
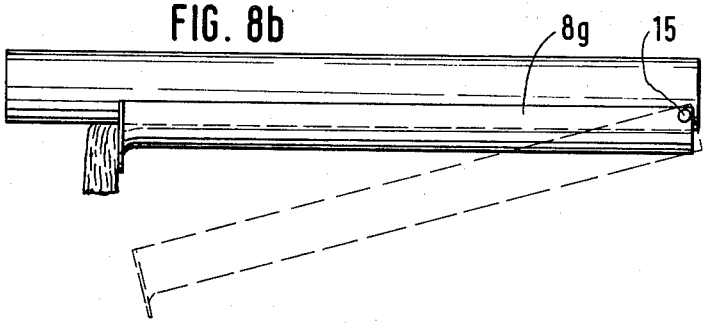

FIGS. 8*a* and 8*b* show a one-piece guide element 8*g*, the lateral edge 13*g* of which is associated with a pivot element 15 and the other lateral edge 17*g* of which has an outwardly bent rounded portion 19*g*. The lateral edge 17*g* is so arranged that the location of web deflection is at a distance from the ends of the two crush rolls 5 and 6 (the distance is measured parallel to the axes of the rolls). It is feasible to so arrange the guide member 8*g* that its lateral edges 13*g* and 17*g* are switched, that is, the lateral edges 13*g* and 17*g* may be associated with the respectively opposite ends of the crush rolls 5 and 6. After rotation about the pivot element 15, the guide element 8*g* assumes its position shown in broken lines, as shown in FIG. 8*b*. This embodiment permits, as a structural simplification, a one-sided asymmetrical installation of the trumpet 7 with the calender rolls for drawing off the card sliver.

Figure 9A:
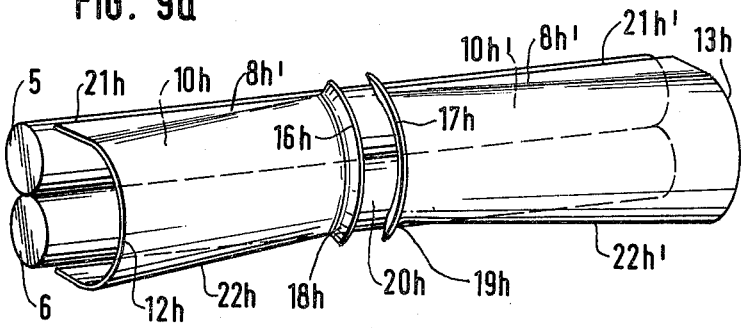

FIG. 9*a* illustrates a two-piece guide element which consists of parts 8*h* and 8*h'*. The lateral edges 16*h* and 17*h* of the guiding faces 10*h* and 10*h'* are rounded at 18*h* and 19*h;* between the latter there is provided a throughgoing (that is, both upwardly and downwardly open) vertically oriented slot 20*h*. The radii of curvature of the outer lateral edges 12*h* and 13*h* of the guide element parts 8*h* and 8*h'* are smaller than the radii of curvature of the inner lateral edges 16*h* and 17*h*. The longitudinal edges 21, 21' of the guiding faces 10*h* and 10*h'* extend parallel to the crush rolls 5 and 6, while the generatrices of the guiding faces 10*h* and 10*h'* form an acute angle with the longitudinal axes of the crush rolls 5 and 6. The openings of the angles which are associated with the guiding faces 10*h* and 10*h'* are oriented back-to-back. This embodiment is advantageous in that an acceleration of the air is effected within the guide element parts 8*h* and 8*h';* this causes a densification of the web in the direction of the slot 20*h*.

Figure 9B:
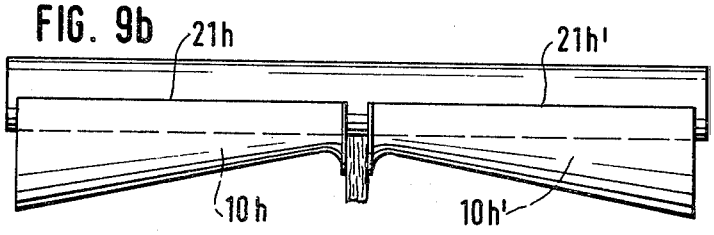
Figure 10A:
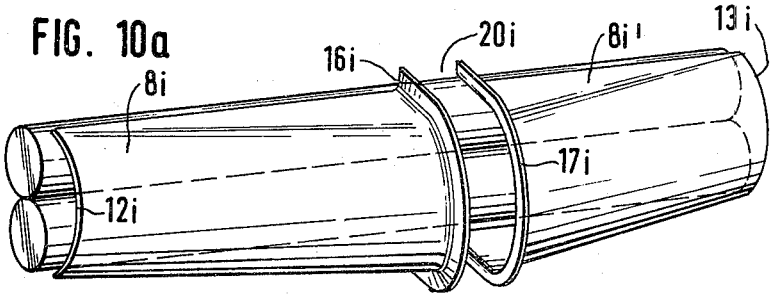
Figure 10B:
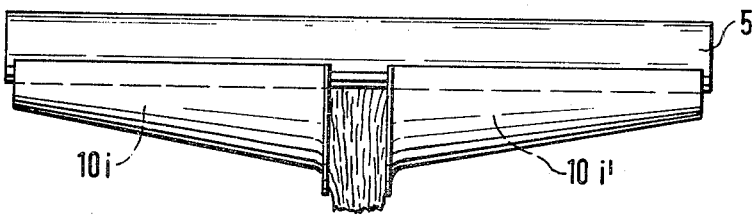

FIG. 10*a* shows a two-part guide element, in which the guide element parts 8*i* and 8*i'* are similar to the embodiment shown in FIGS. 9*a* and 9*b*, except that the radii of curvature of the outer lateral edges 12*i* and 13*i* are greater than the radii of curvature of the inner lateral edges 16*i* and 17*i*. FIG. 10*b* shows that the generatrices of the guiding faces 10*i* and 10*i'* form an acute angle with the longitudinal axes of the crush rolls 5 and 6. The openings of these two angles are oriented towards one another. This embodiment is advantageous in that it provides increased space for the withdrawn web and therefore it is particularly adapted to handle relatively thick card slivers.

Figure 11A:
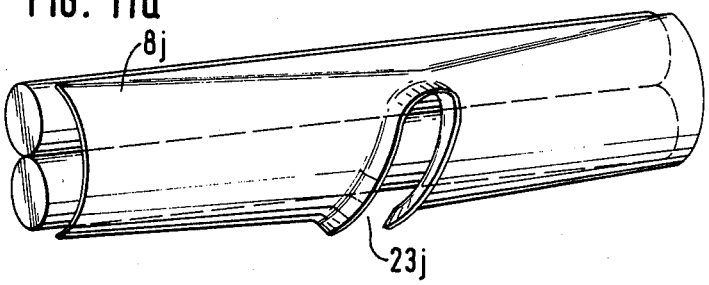
Figure 11B:
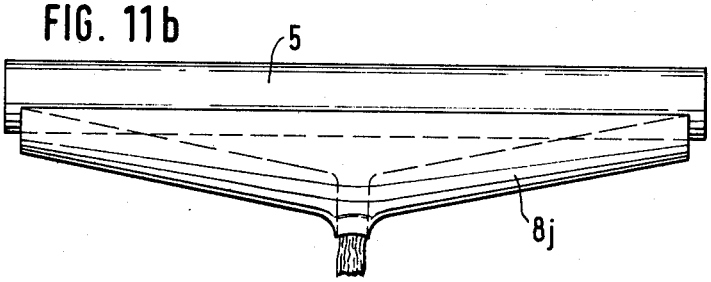

FIGS. 11*a* and 11*b* show a guide element 8*j* which is similar to the embodiment according to FIGS. 10*a* and 10*b*, but which, however, is a one-piece component. In the mid zone of the guide element 8*j*, there is provided an only downwardly open slot 23*j*.

Figure 12A:
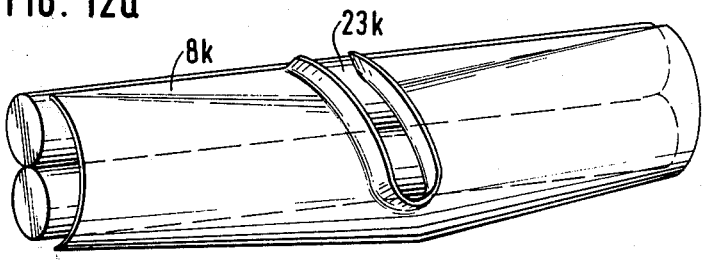
Figure 12B:
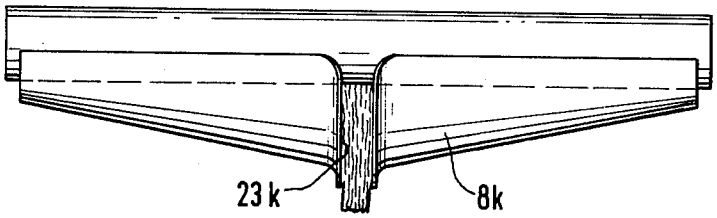

FIGS. 12*a* and 12*b* show an embodiment of a guide element 8*k* which is similar to that of FIGS. 11*a* and 11*b*, but which, however, has an only upwardly open slot 23*k*.

Figure 13A:
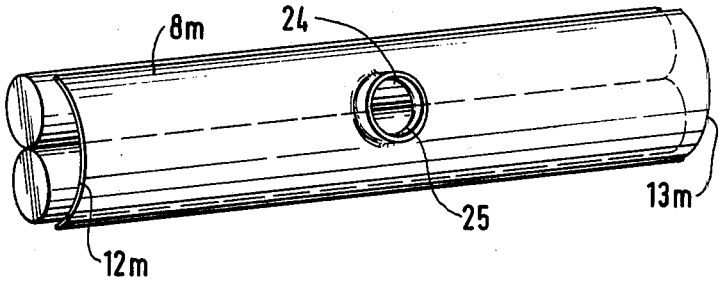
Figure 13B:
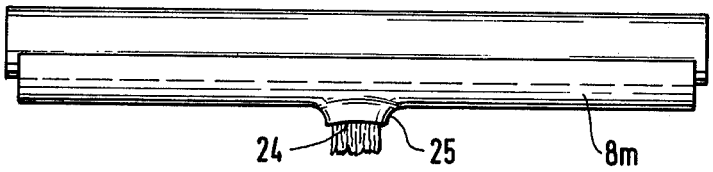

Turning now to FIGS. 13*a* and 13*b*, there is shown a one-piece guide element 8*m* in which, in the middle between the lateral edges 12*m* and 13*m*, there is provided a circular outlet opening 24 having a rounded edge 25. This embodiment is of particularly simple structure and permits a very secure guidance of the card sliver discharged through the circular outlet opening 24.

Figure 14A:
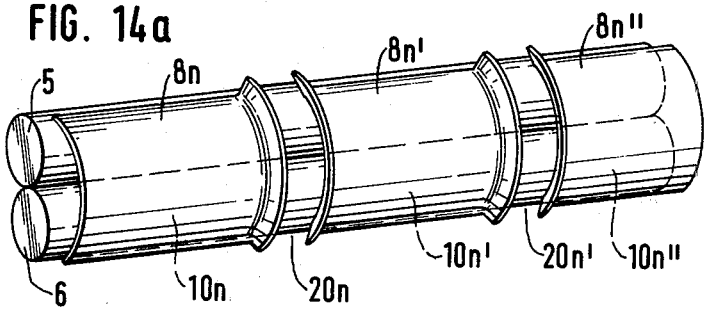
Figure 14B:
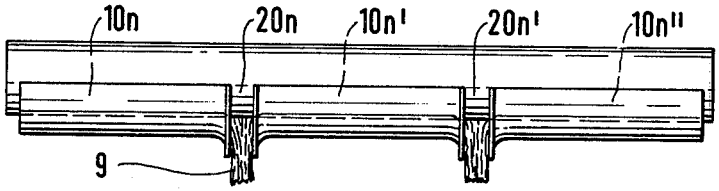

Turning now to FIGS. 14*a* and 14*b*, the guide element shown therein is constituted by a series of guide element parts 8*n*, 8*n'* and 8*n''* extending parallel to the crush rolls 5 and 6. Between the guiding faces 10*n* and 10*n'*, there is provided a throughgoing vertical slot 20*n*, whereas between the guiding faces 10*n'* and 10*n''*, there is provided a vertical throughgoing slot 20*n'*. FIG. 14*b* illustrates how the fiber web 9 is subdivided twice in its gathered condition and withdrawn through the slots 20*n* and 20*n'*.

Figure 15A:
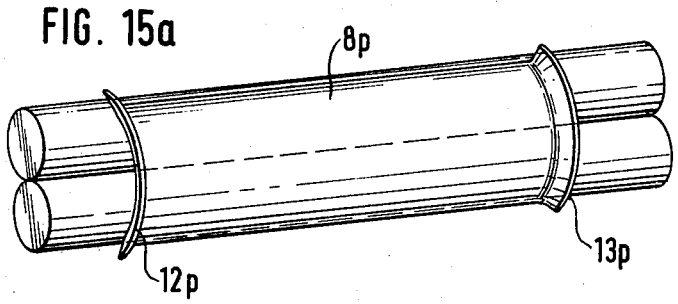
Figure 15B:
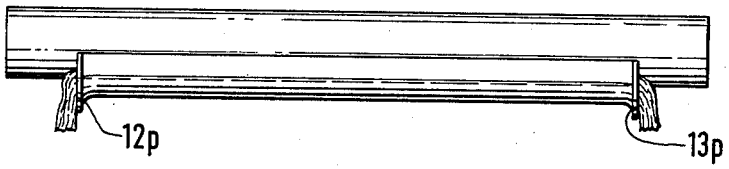

FIGS. 15*a* and 15*b* show one-part guide element 8*p* with which a web division is effected by guiding the divided fiber web about the rounded lateral edges 12*p* and 13*p*.

Figure 16A:
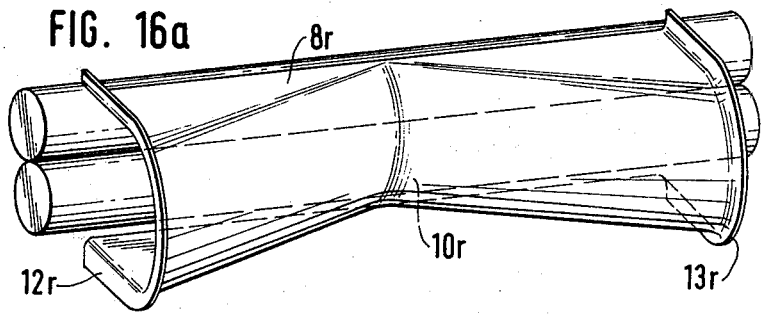
Figure 16B:
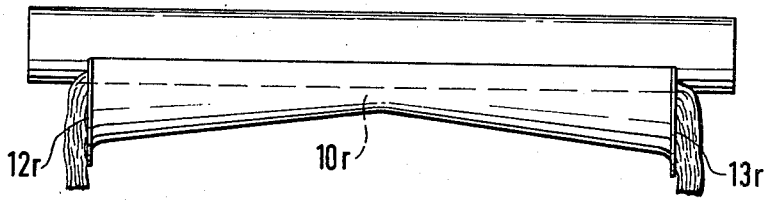

FIGS. 16*a* and 16*b* show a one-part guide element 8*r* which is similar to the embodiment shown in FIGS. 15*a* and 15*b*, but in which, however, the radii of curvature of the outer lateral edges 12*r* and 13*r* are greater than the radius of curvature of the guiding face 10*r* in the mid zone between the two lateral edges 12*r* and 13*r*.

The embodiment illustrated in FIGS. 14*a*, 15*a*, 16*a* as well as 14*b*, 15*b* and 16*b* make possible a division of the fiber web and thus the withdrawal of two or more card slivers. This web division is of particular advantage in case the working width of the card cylinder 1 is greater than 1 meter.

Figure 17A:
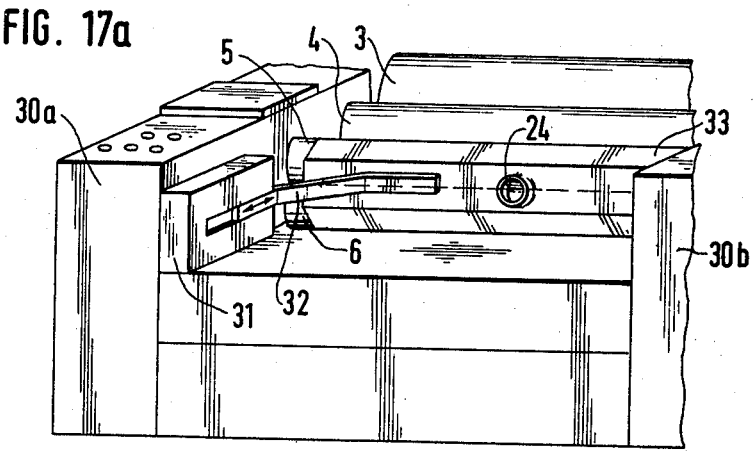
FIGS. 17*a* and 17*b* are, respectively, perspective and side elevational views of a preferred embodiment of an attachment of the guiding device to a carding machine.
Figure 17B:
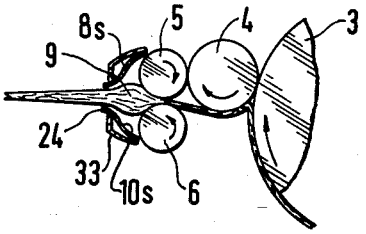

FIG. 17*a* shows two lateral frame components 30*a* and 30*b* of a carding machine. To the inside of the lateral frame component 30*a*, there is secured a support element 31 in which one end of a mounting member 32 is displaceably received. The other end of the mounting member 32 is affixed to the backside of a holder member 33. The latter is of prismatic configuration and has three planar faces which are arranged at an angle with one another. The holder member 33 is open in the direction of the crush rolls 5 and 6. FIG. 17*b* shows a cross section of the structure illustrated in FIG. 17*a*. In the inner space of the holder member 33, there is secured a guide element 8*s*. The fiber web 9 is discharged by the crush rolls 5 and 6 and is then folded together and discharged through the opening 24 of the guide element 8*s* as a card sliver.

Figure 18:
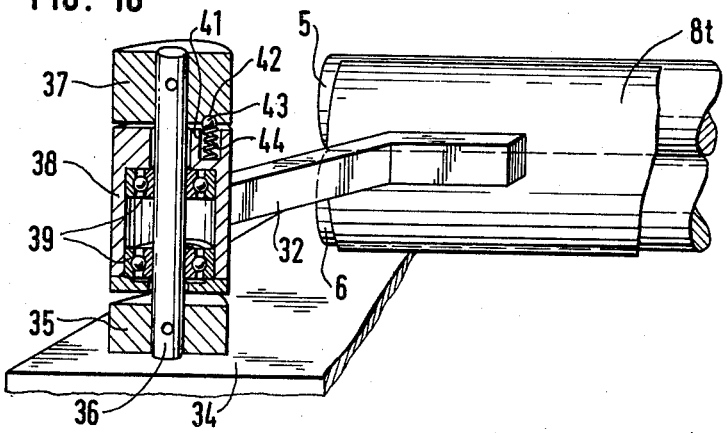
FIG. 18 is a fragmentary perspective view (partially in section) of another embodiment relating to the mounting, supporting and immobilizing of the guide element.

FIG. 18 illustrates a transversal, horizontally oriented base plate 34 extending between the two side frames (not shown) of the carding machine. To the base 34 there is secured a bearing element 35 into which there is inserted a vertically oriented pin 36 and which, with its other end, projects into a closure element 37. A mounting member 32 carries at one end a hollow cylindrical sleeve 38 which houses a bearing 39 surrounding the pin 36. The other end of the mounting member 32 is secured to the backside of the guide element 8*t*. By virtue of this arrangement, the guide element 8*t* is pivotally supported, so that a translational and rotary motion of the guide element 8*t* may be effected. For immobilizing the guide element 8*t*, in the closure member 37 there is provided a semi-spherical recess 42, while in the sleeve 38, in alignment with the recess 42, there is provided a blind bore 41 which accommodates a compression spring 42, urging a ball 43 into the the recess 42.

The web guiding device according to the invention was described in conjunction with a web delivering assembly constituted by crush rolls 5 and 6. It is to be understood that the web guiding device according to the invention may find application in any other desired type of web withdrawing arrangements.

It will be understood that the above description of the present invention is susceptible to various modifications, changes and adaptations, and the same are intended to be comprehended within the meaning and range of equivalents of the appended claims.

What is claimed is:

1. In a carding machine including a cylinder; a web delivering assembly arranged downstream of the cylinder and including a pair of cooperating rolls for delivering a running fiber web; a device arranged downstream of the web delivering assembly for gathering the running fiber web; the device including at least one operationally substantially stationary guide element having a hollow guiding face, the improvement wherein said guide element is supported downstream of and immediately adjacent to said rolls; said hollow guiding face extending transversely to the direction of web discharge by said rolls and shrouding at least one part of both said rolls; and said hollow guiding face having upper and lower longitudinal bounding edges extending immediately adjacent and parallel to the one and the other of said rolls, whereby air is substantially prevented from impinging on the running web from the outside.

2. A device as defined in claim 1, wherein said guiding face shrouds said rolls substantially in their entirety on the side the web is discharged.

3. A carding machine as defined in claim 1, wherein said guide element has opposite first and second ends; further wherein said guide element is supported at said first end for pivotal motion about a vertical axis; further wherein said guide element has a rounded lateral edge at said second end; and further wherein said guide element has an uninterrupted surface, whereby the fiber web gathered by the guide element is discharged solely at said second end.

4. A device as defined in claim 1, wherein said guiding face extends parallel to said rolls.

5. A device as defined in claim 1, wherein said guiding face extends at an oblique angle with respect to said rolls.

6. A device as defined in claim 1, further comprising adjusting means for providing mobility of said guide element towards or away from said rolls.

7. A carding machine as defined in claim 6, wherein said adjusting means comprises means for providing mobility of said guide element parallel to said direction of web discharge.

8. A carding machine as defined in claim 6, wherein said adjusting means comprises means for providing pivotal mobility of said guide element about a vertical axis.

9. A carding machine as defined in claim 6, wherein said adjusting means comprises means for providing pivotal mobility of said guide element about a horizontal axis.

10. A carding machine as defined in claim 1, wherein said guiding face is concave.

11. A carding machine as defined in claim 10, wherein said guiding face has a curved surface.

12. A carding machine as defined in claim 10, wherein said guiding face comprises at least two planar surfaces arranged at an angle to one another.

13. A carding machine as defined in claim 1, further comprising means defining at least one discharge opening in said guide element.

14. A carding machine as defined in claim 13, wherein said discharge opening has an entirely closed outline.

15. A carding machine as defined in claim 10, wherein said discharge opening has an outline which is open at one side.

16. A carding machine as defined in claim 1, wherein said guide element has opposite lateral edges and said rolls have opposite ends; said opposite ends of said rolls projecting beyond the respective opposite lateral edges of said guide element.

17. A carding machine as defined in claim 1, wherein said guide element is formed of at least two guide element parts spaced from one another to define a throughgoing slot between themselves.

18. A carding machine as defined in claim 1, wherein said guide element has at least one rounded lateral edge for guiding the web thereon.

19. A carding machine as defined in claim 1, wherein said guiding face extends, from its middle, at inclined angles towards opposite ends of said rolls.

20. A carding machine as defined in claim 19, wherein openings of said angles are arranged back-to-back.

21. A carding machine as defined in claim 19, wherein openings of said angles are oriented towards one another.

* * * * *